US006971515B2

(12) United States Patent
Cooper et al.

(10) Patent No.: US 6,971,515 B2
(45) Date of Patent: Dec. 6, 2005

(54) FASTENER CLIP AND FASTENER DISPENSING TOOL

(75) Inventors: William J. Cooper, Woonsocket, RI (US); Jeffrey A. Raymond, Leominster, MA (US)

(73) Assignee: Avery Dennison Corporation, Pasadena, CA (US)

( * ) Notice: Subject to any disclaimer, the term of this patent is extended or adjusted under 35 U.S.C. 154(b) by 368 days.

(21) Appl. No.: 10/006,779

(22) Filed: Nov. 5, 2001

(65) Prior Publication Data

US 2002/0121538 A1 Sep. 5, 2002

Related U.S. Application Data

(60) Provisional application No. 60/245,477, filed on Nov. 3, 2000.

(51) Int. Cl.[7] ..... A44B 9/00; B65D 85/24
(52) U.S. Cl. ..... 206/343; 24/711.1
(58) Field of Search ..... 206/343–348; 24/711.1; 40/668

(56) References Cited

U.S. PATENT DOCUMENTS 3,733,657 A * 5/1973 Lankton ..... 206/343
3,759,435 A 9/1973 Bone
3,888,402 A 6/1975 Bone
3,901,428 A 8/1975 Grass
3,906,611 A 9/1975 Merser
4,049,176 A 9/1977 Jenkins
4,111,347 A 9/1978 Bone
4,417,656 A * 11/1983 Kato ..... 206/346
4,465,218 A 8/1984 Furutsu (Continued)

*Primary Examiner*—Jim Foster
(74) *Attorney, Agent, or Firm*—Kriegsman & Kriegsman

(57) ABSTRACT

A tool for dispensing plastic fasteners from a fastener clip, each plastic fastener in the fastener clip having a cross bar coupled to a common runner bar by a stub. The tool comprises a gun shaped casing having a front, a rear and a top. A guide groove extends down from the top for receiving the fastener clip. A hollow slotted needle is mounted in the front of the gun shaped casing, the hollow needle having an inlet opening in communication with the guide groove and an outlet opening. The hollow needle includes an anti-back and a knife edge. An ejector slide is disposed within the gun shaped casing and movable back and forth therein. A feed slide is disposed within the gun shaped casing and movable back and forth therein. A feed cam is disposed inside the casing is rotably mounted at one place onto the casing and pivotally mounted at another place onto the feed slide. The feed cam includes a front surface having a pair of outwardly extending spaced apart pins. A feed pawl is disposed on the feed cam between the pair of pins, the feed pawl having a tooth for engaging the stub of a plastic fastener so that the cross bar of a plastic fastener to be dispensed is advanced into alignment with the inlet opening of the hollow needle. An ejector rod is mounted on the ejector slide for pushing a plastic fastener to be dispensed through the hollow slotted needle and a trigger link assembly is provided for moving the ejector slide and the feed slide back and forth within the casing. In the operation of the apparatus, movement of the feed slide back and forth will cause rotational movement of the feed cam which in turn will cause upward and/or downward movement of the pair of spaced apart pins on the feed cam carrying with it the feed pawl and movement of the ejector slide back and forth will move the ejector rod into and out of the hollow needle.

16 Claims, 16 Drawing Sheets

U.S. PATENT DOCUMENTS 4,482,088 A 11/1984 Hyun
4,511,073 A 4/1985 Furutsu
4,533,076 A 8/1985 Bourque
4,534,464 A * 8/1985 Lankton ..... 206/343
4,592,500 A 6/1986 Kato
4,651,913 A 3/1987 Bone
4,664,306 A 5/1987 Levy
4,819,855 A 4/1989 Satoh et al.
4,971,238 A 11/1990 Furutsu
5,074,452 A 12/1991 Bone
5,388,748 A 2/1995 Davignon et al.
5,388,749 A 2/1995 Davignon et al.
5,398,859 A 3/1995 Lee
5,529,233 A 6/1996 Davignon et al.
5,683,025 A 11/1997 Grendol
5,772,073 A 6/1998 Deschenes
5,987,719 A 11/1999 Cooper
6,047,823 A 4/2000 Deschenes et al.
6,129,206 A 10/2000 Cooper
6,173,836 B1 1/2001 Cooper
6,267,285 B1 7/2001 Raymond et al.
6,293,399 B1 9/2001 Cooper
6,308,386 B1 10/2001 Cooper
6,418,597 B1 7/2002 Deschenes et al.
6,446,801 B2 9/2002 Cooper

* cited by examiner

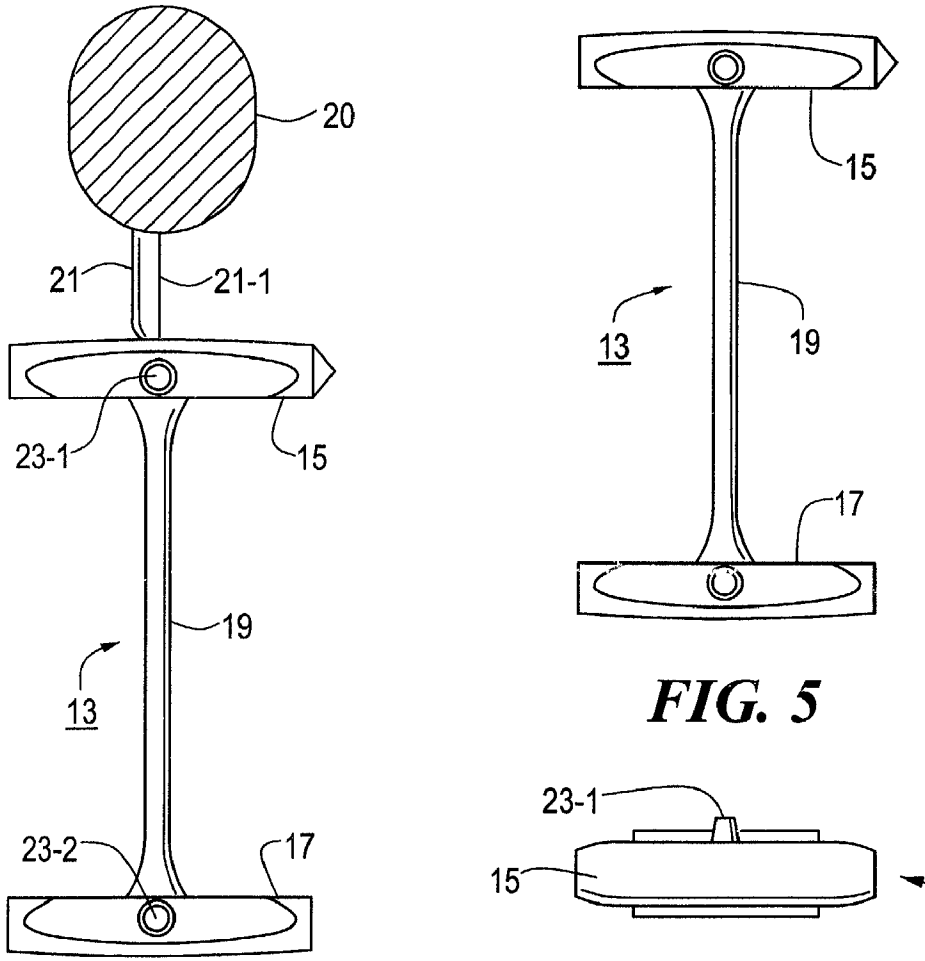
FIG. 4
FIG. 5
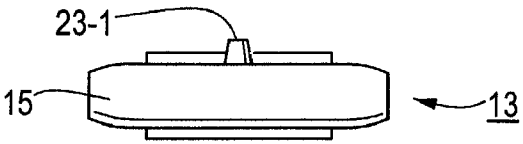
FIG. 6
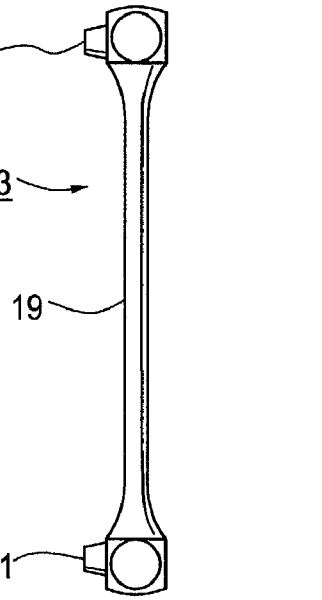
FIG. 7

FASTENER CLIP AND FASTENER DISPENSING TOOL

CROSS REFERENCE TO RELATED APPLICATIONS

The present application claims the benefit under 35 USC 119(e) of U.S. Provisional Patent Application Ser. No. 60/245,477 filed on Nov. 3, 2000, the disclosure of which is incorporated herein by reference.

BACKGROUND OF THE INVENTION

The present invention relates generally to the fastening of objects using plastic fasteners and more particularly to a novel fastener clip and a novel fastener dispensing tool.

Plastic fasteners having a cross bar at one end, a cross bar or a paddle at the other end and a thin filament or cross-link connecting the two ends are well known in the art and widely used in commerce to couple together two parts of a single object or two or more objects, such as examples to couple or recouple a button to an article of clothing or to attach labels, price tags or other items to articles in a manner which minimizes the risk or inadvertent detachment therefrom. Typically, such plastic fasteners are manufactured in the form of fastener stock, the fastener stock being produced by molding or stamping from flexible plastic materials, such as nylon, polyethylene, and polypropylene.

In one known type of fastener stock, a cross bar at one end of each fastener is connected by a stub to a runner bar to form a clip of fasteners.

Additional information pertaining to fastener stock may be found in U.S. Pat. No. 6,173,836, U.S. Pat. No. 4,955,475, U.S. Pat. No. 4,456,161, U.S. Pat. No. 4,121,487, U.S. Pat. No. 3,470,834 and U.S. Pat. No. 3,103,666.

The dispensing of individual fasteners from fastener stock is often accomplished with an apparatus commonly referred to as a "tagger gun". Typically, a tagger gun is a hand held trigger operated device which is constructed to accept fastener stock in a guide groove formed in the body of the gun. Tagger guns usually include a mechanism for feeding the cross bar end of an individual fastener in the fastener stock inserted into the guide groove into alignment with the longitudinal axis of a hollow needle at the front end of the gun and a mechanism for pushing the cross bar end of the fastener through the hollow needle and then out through the tip fo the hollow needle. Some tagger guns are manually operated while other tagger guns are powered by an electric motor.

In U.S. Pat. No. 6,293,399 there is disclosed a unitary plastic fastener clip comprising a plurality of individual fasteners which are disposed in a substantially parallel, side-by-side, spaced relationship. Each fastener comprises an elongated flexible filament having a first enlarged end and a second enlarged end. In one embodiment, each of the first enlarged end and the second enlarged end is a substantially cylindrical transverse bar. In another embodiment, the first enlarged end is a transverse bar of non-uniform transverse cross-section and the second enlarged end is a generally knob-shaped head. A first connector post connects the first enlarged end of the first fastener to the first enlarged end of the second fastener at the approximate midpoints of their mutually-opposing sides. A second connector post connects the second enlarged end of the first fastener to the second enlarged end of the second fastener at the approximate midpoints of their mutually-opposing sides. The first and second connector posts, which may be uniform in transverse cross-section or may taper towards one end, are preferably sufficiently flexible to permit the first enlarged ends of the first and second fasteners to pivot relative to one another and to permit the second enlarged ends of the first and second fasteners to pivot relative to one another.

In U.S. Pat. No. 6,047,823 there is disclosed a method of maintaining an article of clothing, such as a dress shirt, in a folded condition and a plastic fastener well-suited for use in the method. According to one embodiment, the plastic fastener is a unitary structure made of polypropylene and comprises a flexible filament having a first cross-bar at a second end thereof. The filament has a length of about 7 mm and has a tensile strength of about 4 pounds. Preferably, the fastener is molded as part of a clip, the clip comprising a plurality of identical such fasteners arranged side-by-side, with the respective first cross-bars parallel to one another and the respective second cross-bars parallel to one another, each of the first cross-bars being joined to a common, orthogonally disposed runner bar by a severable connector. In use, the clip is loaded into a tagging gun of the type intended for use with runner bar-type clips, the dress shirt is folded in the desired manner, and the first cross-bar of a fastener is dispensed by the tagging bun into and completely through the folded shirt at an appropriate pair of locations, with the second cross-bar not being inserted into the dress shirt. Additional fasteners may be used, where desired, in the same manner to ensure that the shirt remains folded in other areas thereof, to unfold the shirt, one merely pulls apart the two portions of the shirt folded together until the filament of the fastener connecting the two portions breaks.

In U.S. Pat. No. 5,683,025 there is disclosed an apparatus for dispensing plastic fasteners from a clip of fastener stock, each fastener having a cross bar coupled to a common runner bar by a stub. The apparatus includes a gun shaped casing made of plastic. A hollow needle having an inlet opening and an outlet opening is mounted on the front of the casing. A guide groove is formed in the casing for receiving the fastener stock, the guide groove being in communication with the inlet opening of the hollow needle. The guide groove includes a stub receiving portion bounded by a front wall, The apparatus also includes a feed member mounted on the casing behind the guide groove. The feed member includes a tooth having a lower surface which engages the stub of an individual fastener to advance the fastener stock so that the cross bar of the fastener to be dispensed is advanced into alignment with the inlet opening of the hollow needle.

In U.S. Pat. No. 5,497,930 there is disclosed a tag attacher constructed so that a feed member from which a tooth engageable with a connecting portion of a tag pin projects and a stopper member from which a tooth engageable in parallel with the tooth with the connecting portion projects extend in parallel with each other, the feed member having a head portion and a lever portion extended from the head portion, the feed member being turned directly in accordance with the forward and backward movements of a movable member so as to transfer the tag pin to a predetermined position.

In U.S. Pat. No. 5,388,749 there is disclosed an apparatus for dispensing plastic fasteners from fastener stock includes a gun shaped casing. A hollow needle having an inlet opening is mounted on the casing. A guide groove is formed on the casing for receiving the fastener stock, the guide groove being in communication with said inlet opening in said hollow needle. A feeder element for intermittently advancing fastener stock loaded into the guide groove is mounted on the casing. An ejector rod is provided for pushing plastic fasteners form the fastener stock through and out of the hollow needle one at a time.

In U.S. Pat. No. 5,074,452 there is disclosed a tag attaching gun in which an ejector rod is advanced by a trigger operated lever to sever an individual fastener from a fastener assemblage and dispense the severed fastener through a hollow slotted needle. This apparatus incorporates a unitary, single-tooth feed member for advancing the fastener assemblage to bring the forward most fastener in line with the needle. Such feed member comprises a reciprocally mounted body integral with a U-shaped resilient finger terminating in a feed tooth. The feed member together with its resilient feed finger moves linearly in order to engage and advance the fastener assemblage, while the finger flexes during a return motion in order to clear a succeeding fastener in the assemblage.

In U.S. Pat. No. 4,511,073 there is disclosed a fastener dispensing device having an improved fastener feeding mechanism. The feeding mechanism includes a friction wheel rotatably supported on the device adjacent the guide groove from the fastener assembly and abutting against the connection necks of the fasteners. A support plate is mounted coaxially with the friction wheel and is adapted to pivot when the operation lever of the device is pivoted. A wheel driving member is pivotably supported on the support plate and includes a projecting portion which selectively engages the friction wheel with the projecting portion engaging and rotating the friction wheel when the operation lever is pivoted to cause the friction wheel to move the fastener assembly so that the next fastener is moved to a prescribed discharge position to be pushed through the hollow needle of the dispensing device.

In U.S. Pat. No. 4,482,088 there is disclosed a tag attaching apparatus a frame, a hollow needle for attaching fasteners, a fastener supply gear wheel, a plunger the sliding motion of which actuates a bell crank mechanism for incrementing the fastener supply gear wheel, and a pawl which prevents reverse motion of the fastener supply gear wheel.

In U.S. Pat. No. 4,456,162 there is disclosed an arrangement for feeding a tag pin assembly in this tag attacher consists of a cam plate which can be moved up and down along a guide bore in which the tag pin assembly is inserted, a locking member pivotably provided on the cam plate, and a spring provided between the locking member and the tag attacher body. The locking member has locks adapted to come into contact with the opposite surfaces of a connecting bar in the tag pin assembly so as to apply force thereto for moving the same. When the cam plate is moved upward against the force of the spring during a tag pin-driving operation, opposite surfaces of the connecting bar are pressed and held by the locking member oscillatably provided on the cam plate. When the lever provided on the tag attacher body is released from the gripping force applied thereto, the cam plate is lowered by the resilient force of the spring to feed a tag pin in the tag pin assembly to a driving position in a rear portion of a side-slitted needle.

In U.S. Pat. No. 4,416,407 there is disclosed an arrangement for dispensing of fasteners by a device which receives an assemblage of the fasteners and is able to expel them individually through, for example, a slotted hollow needle. The dispensed fasteners can be used generally in the attachment of items to one another and, in particular, for the labeling of textile goods and the like with information bearing tags. The device includes a trigger operated feed mechanism and a simultaneously operable expulsion mechanism. Both mechanisms are controlled by the tip of a lever which is proportioned and disposed in the device to execute linear motion. The feed mechanism is disengageable from the remainder of the device to permit clearance of the inserted assemblage or the removal of jams. The feed mechanism additionally is operated by a planar pawl having a tooth that extends into contact with indentations on the periphery of a feed wheel.

In U.S. Pat. No. 3,888,402 there is disclosed a feed mechanism for locating fastener attachment members one at a time in position for dispensing through a needle or the like, said mechanism comprising a feed wheel having teeth and a pawl resiliently urged toward the wheel, and said pawl slidably moveable across the side of said wheel into and out of the space between the teeth thereof. In addition there is disclosed depressible means for engaging the pawl to move it away from said wheel to permit fastener attachment members to be withdrawn from the apparatus.

In U.S. Pat. No. 3,759,435 there is disclosed an apparatus for dispensing fastener attachment members of the type having a filament with heads on both ends, the device including a casing, a needle projecting form the casing, the needle having a bore through which the fastener attachment member is adapted to be dispensed, a plunger or ejector adapted to force one head of the attachment member through the needle bore, the plunger advanced by the combination of a gear and sliding rack, the sliding rack in the form of a thin plate and in which the attachment members are fed before the needle and in front of the ejector by an indexing wheel advanced by a feed pawl with a slotted hole which allows it to rock in and out of engagement with the indexing wheel as it is moved back and forth.

Other patents of interest include U.S. Pat. No. 6,267,285; U.S. Pat. No. 6,173,836; U.S. Pat. No. 5,772,073; U.S. Pat. No. 5,529,233; U.S. Pat. No. 5,398,859; U.S. Pat. No. 4,969,589; U.S. Pat. No. 4,651,913; U.S. Pat. No. 4,049,176; and U.S. Pat. No. 3,901,428.

SUMMARY OF THE INVENTION

It is an object of the present invention to provide a new and improved fastener dispensing tool for dispensing plastic fasteners from a fastener clip.

It is another object of this invention to provide a new and improved fastener clip.

According to one aspect of the invention, there is provided a fastener dispensing tool for dispensing plastic fasteners from a fastener clip, each plastic fastener in the clip having a cross bar coupled to a common runner bar by a stub, the apparatus comprising a gun shaped casing having a front, a rear and a top, a guide groove extending down from the top for receiving said length of fastener stock, a hollow slotted needle mounted in the gun shaped casing, the hollow slotted needle having an inlet opening in communication with the guide groove and an outlet opening, an ejector slide disposed within the gun shaped casing and movable back and forth therein; a pivoting, spring loaded, feed slide disposed within the gun shaped casing and movable back and forth therein, a feed cam inside the casing rotably mounted at one place onto the casing and pivotally mounted at another place onto the feed slide, the feed cam having a front surface having a pair of outwardly projecting, spaced apart pins; an articulating, spring loaded feed pawl disposed on the front surface of the feed cam between the pair of pins, the feed pawl having a tooth for engaging the stub of a plastic fastener so that the cross bar of a plastic fastener to be dispensed is advanced into alignment with the inlet opening of the hollow needle, an ejector rod mounted on the ejector slide and disposed so as to slidably move back and forth through the hollow slotted needle for pushing a plastic fastener to be dispensed through the hollow slotted needle and out of the hollow slotted needle through the outlet opening, and a trigger link assembly for moving the ejector slide and the feed slide back and forth within the gun shaped casing, wherein, movement of the feed slide back and forth will cause rotational movement of the feed cam which in turn will cause upward and/or downward movement of the pair of spaced apart pins on the feed cam carrying with it the feed pawl and wherein movement of the ejector slide back and forth will move said ejector rod into and out of said hollow slotted needle.

According to another aspect of the invention there is provided a fastener clip comprising a plurality of plastic fasteners and a common runner bar and wherein each plastic fastener is connected to common runner bar through an off-center stub having a flat inner surface terminating in a sharp edge for engaging the tooth on the feed pawl of the fastener dispensing tool.

According to another aspect of the invention, the fastener clip is constructed so as to provide an easy indication of which end of the runner bar is the end to be inserted into the guide groove of the tool.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing form the scope of the invention. The following detailed description is therefore, not be to be taken in a limiting sense, and the scope of the present invention is best defined by the appended claims.

BRIEF DESCRIPTION OF THE DRAWINGS

In the drawings wherein like reference numerals represent like parts.

FIGS. 1 through 4 are side, fragmentary perspective, fragmentary side and lateral section views, respectively of a fastener clip constructed according to this invention, the lateral section view of FIG. 4 being taken between two fasteners in the clip;

FIGS. 5 through 7 are side, top and front views respectively of an individual fastener in the fastener clip shown in FIGS. 1 through 4;

DETAILED DESCRIPTION OF PREFERRED EMBODIMENTS

Figure 1:
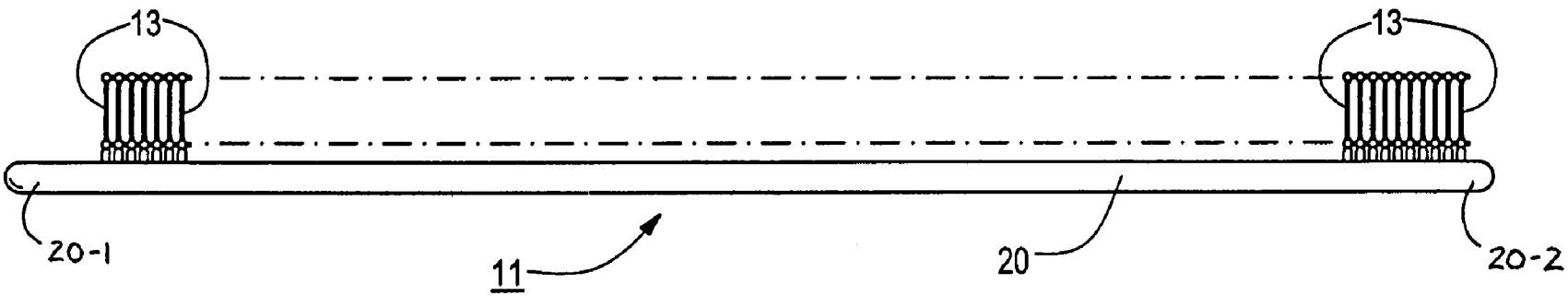
Figure 2:
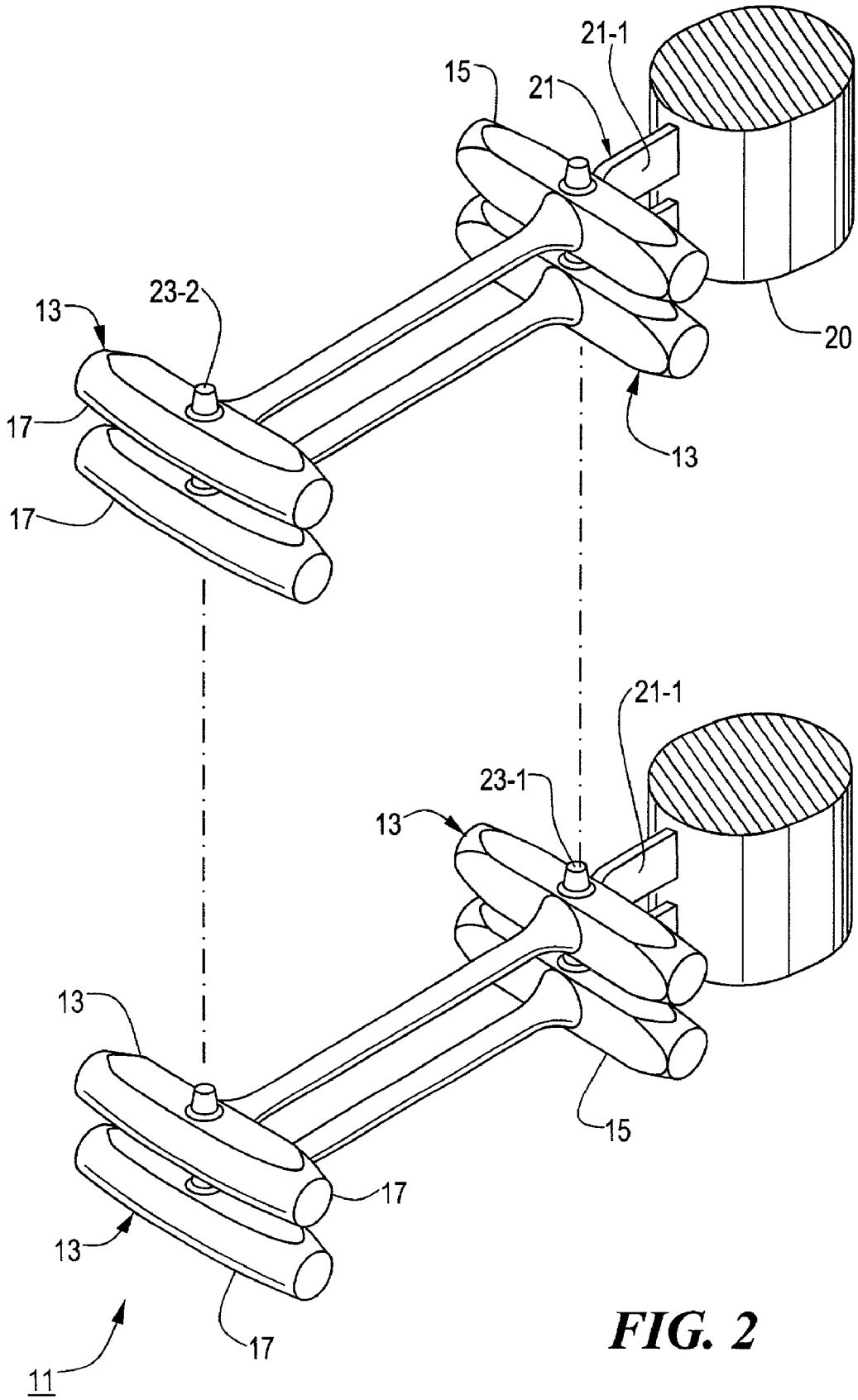
Figure 3:
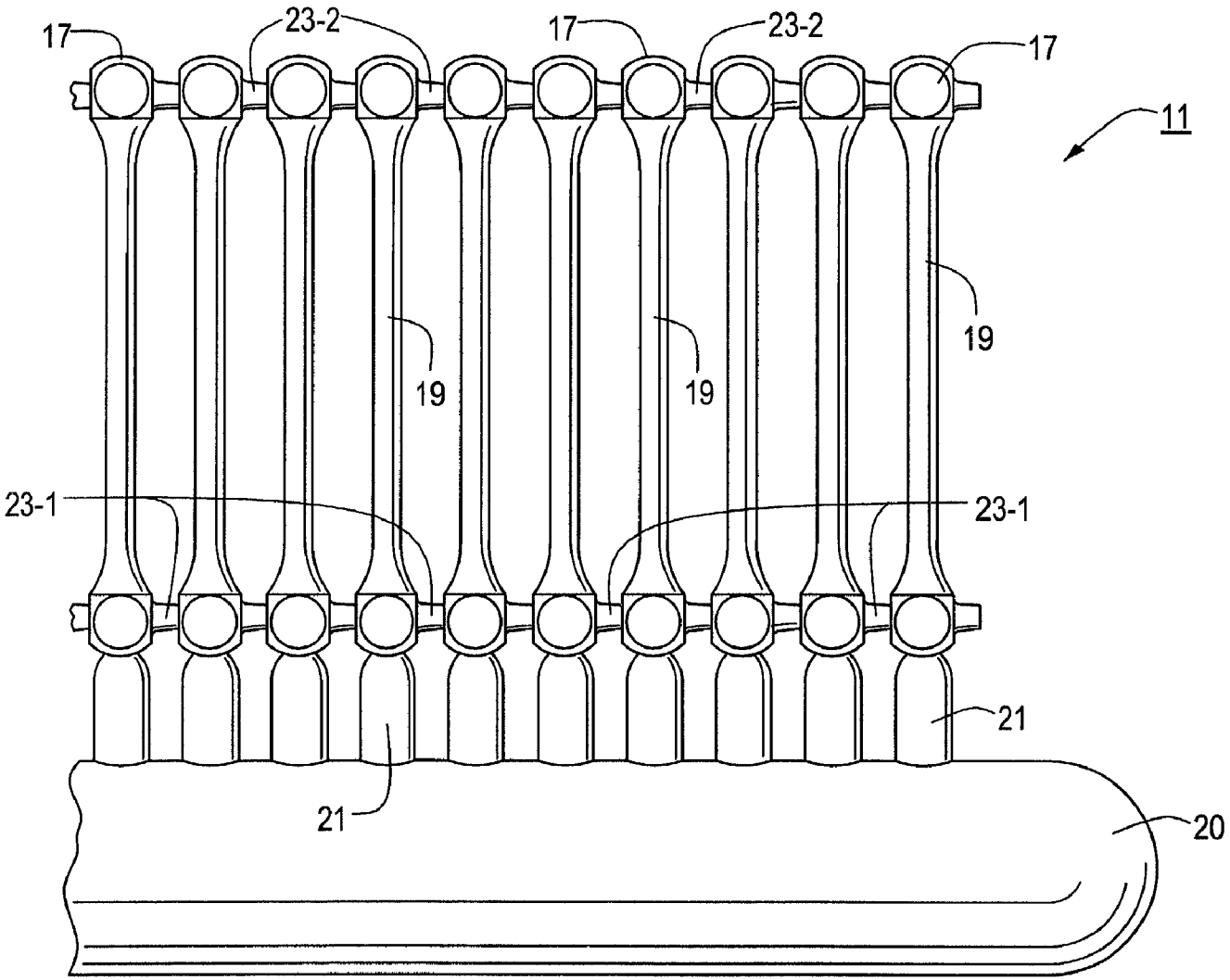

Referring now to the drawings, there are shown in FIGS. 1 through 4, plan, fragmentary perspective, fragmentary side and lateral section views, respectively, of a fastener clip according to this invention, the fastener clip being identified by reference numeral 11. As can be seen, fastener clip 11 includes a plurality of individual fasteners 13, each having a cross bar 15 at one end, a cross bar 17 at the other end and a thin filament 19 connecting the two ends. Each fastener 13 is coupled to a common runner bar 20 through a short off-center stub 21 extending out the cross bar 15. Stub 21 has a inner surface 21-1 which is flat and which terminates in a sharp edge for engaging a tooth on the feed pawl of the apparatus of the invention as will hereinafter be described in detail.

Clip 11 also includes a first plurality of severable connector posts 23-1 and a second plurality of severable connector posts 23-2, connector posts 23-1 connecting the mutually-opposing sides of adjacent cross-bars 15 at their approximate midpoints and extending in a substantially perpendicular direction relative to the longitudinal axes of cross-bars 15 and connector posts 23-2 connecting the mutually-opposing sides of adjacent cross-bars 17 at their approximate midpoints and extending in a substantially perpendicular direction relative to the longitudinal axes of cross-bars 17. Side, top and front views of an individual fastener 13, together with its associated connector posts 23-1 and 23-2, are shown in FIGS. 5 through 7, respectively.

In the present embodiment, connector posts 23-1 and 23-2 have a length L2 of approximately 0.008 inches. Cross-bars 15 and 17 have a length L3 of approximately 0.11 inches and a diameter of approximately 0.022 inches, and the filament, stretched has a length L3 (i.e. between cross-bars of about 0.176 inches.

Fastener clip 11 is made of a plastic such as nylon, polyethylene or polypropylene. In the drawings, fastener clip 11 is shown, by way of example as having one hundred and twenty fasteners 13 with a pitch (i.e. distance between filaments) of approximately 0.032 inches.

Runner bar 20 has a first end 20-1, which is the end that is inserted into the fastener dispensing tool, and a second end 20-2. As can be seen in FIG. 1, end 20-1 extends out further from fasteners 13 than end 20-2 so as to easily indicate which end of the runner bar is to be inserted into the tool (so that surface 21-1 of each stub will be facing in the correct direction).

In another version of the fastener clip, connector posts 23-2 are eliminated so that cross-bars 17 are unconnected.

Figure 8:
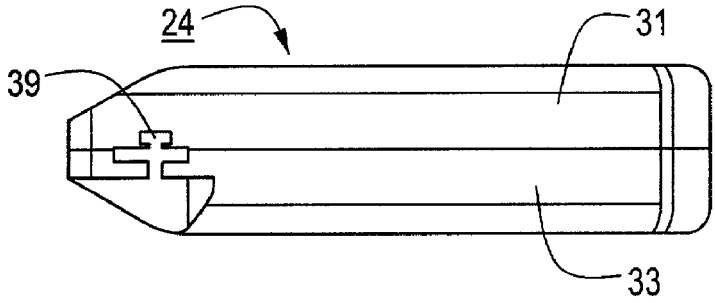
FIGS. 8 and 9 are top and side perspective views of tool according to this invention for dispensing plastic fasteners from the fastener clip shown in FIGS. 1 through 4; the view in FIG. 9 including the fastener clip of FIGS. 1 through 4 partially inserted in the tool.
Figure 9:
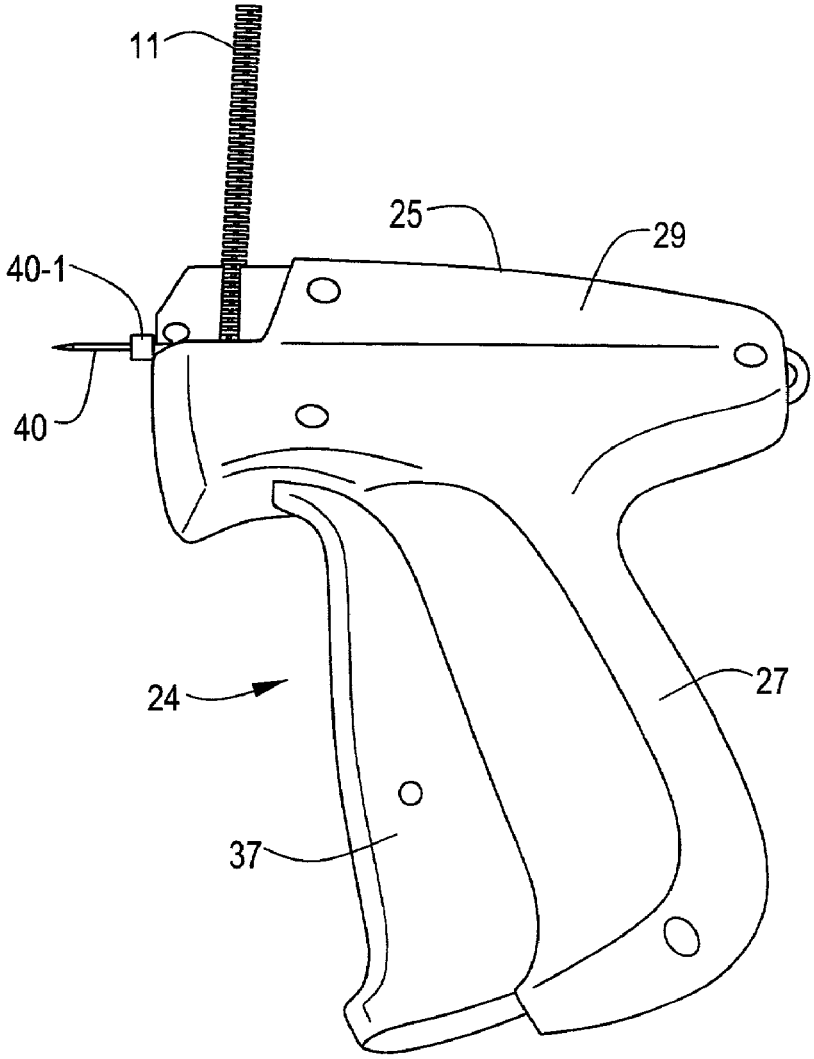
Figure 10:
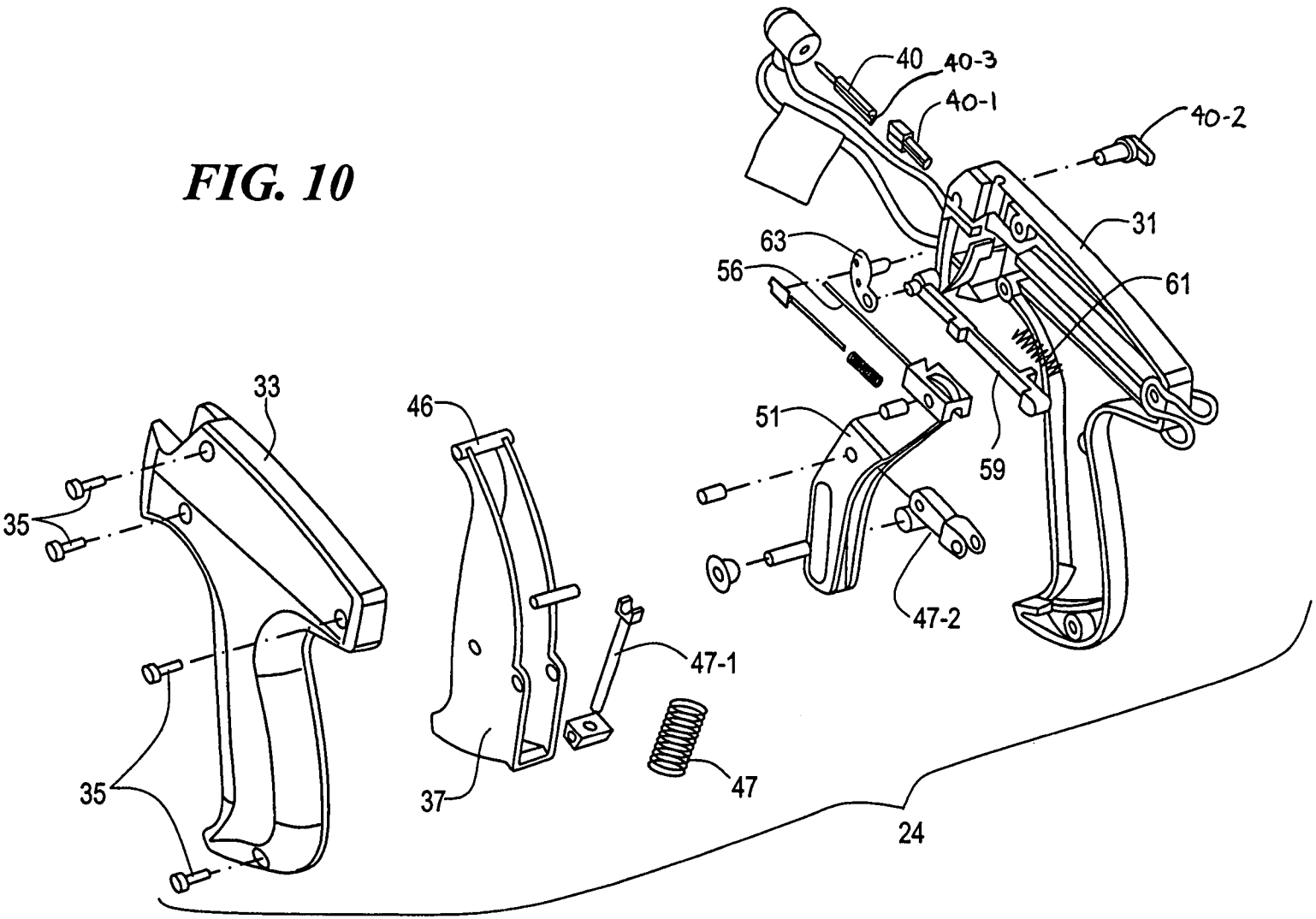
FIG. 10 is an exploded perspective view of the tool shown in FIG. 9, with the addition of a needle guard.
Figure 11:
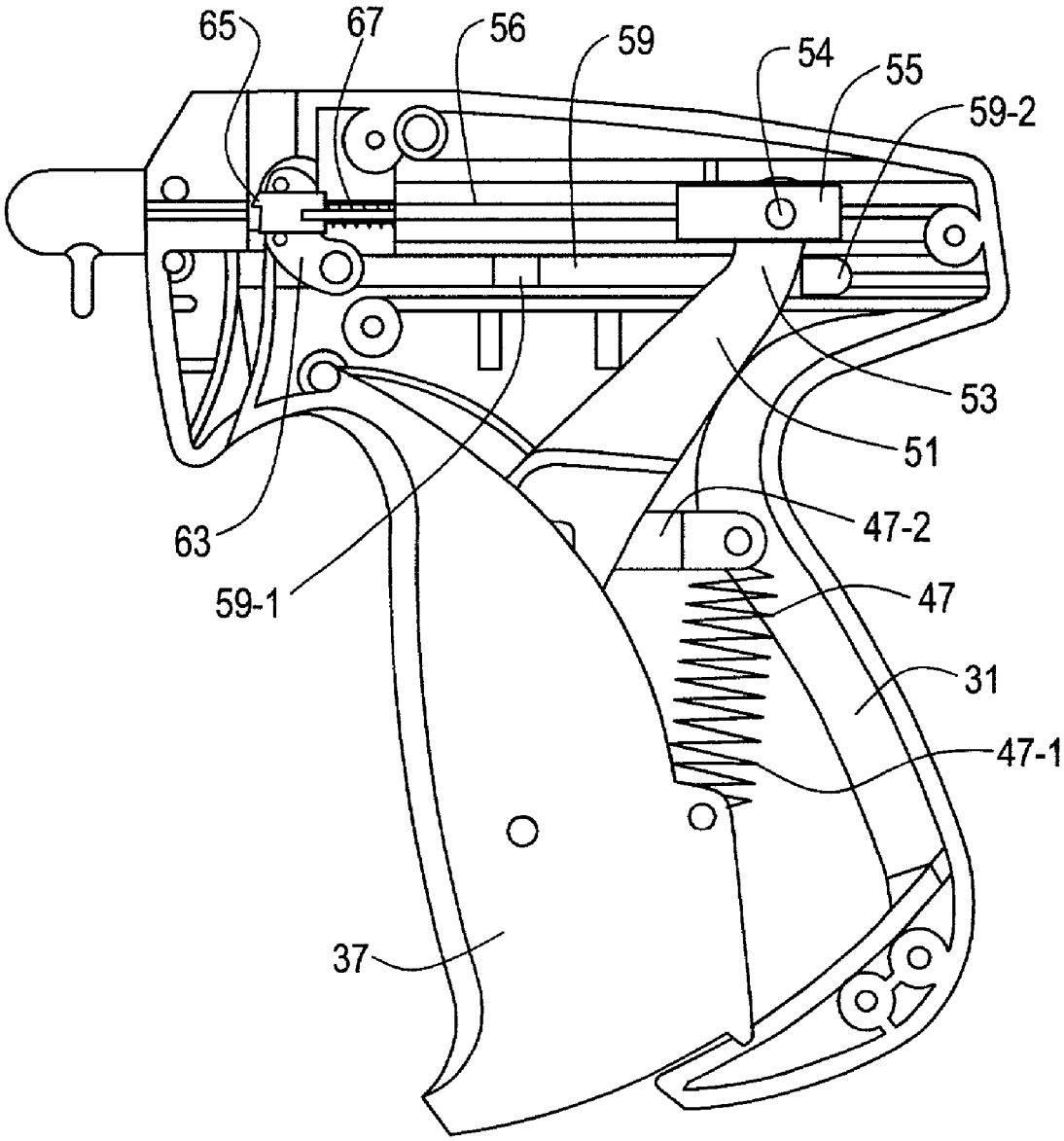
FIG. 11 is a side view of the tool shown in FIG. 9, with the left half of the casing removed and the feed slide in a feed position.
Figure 11A:
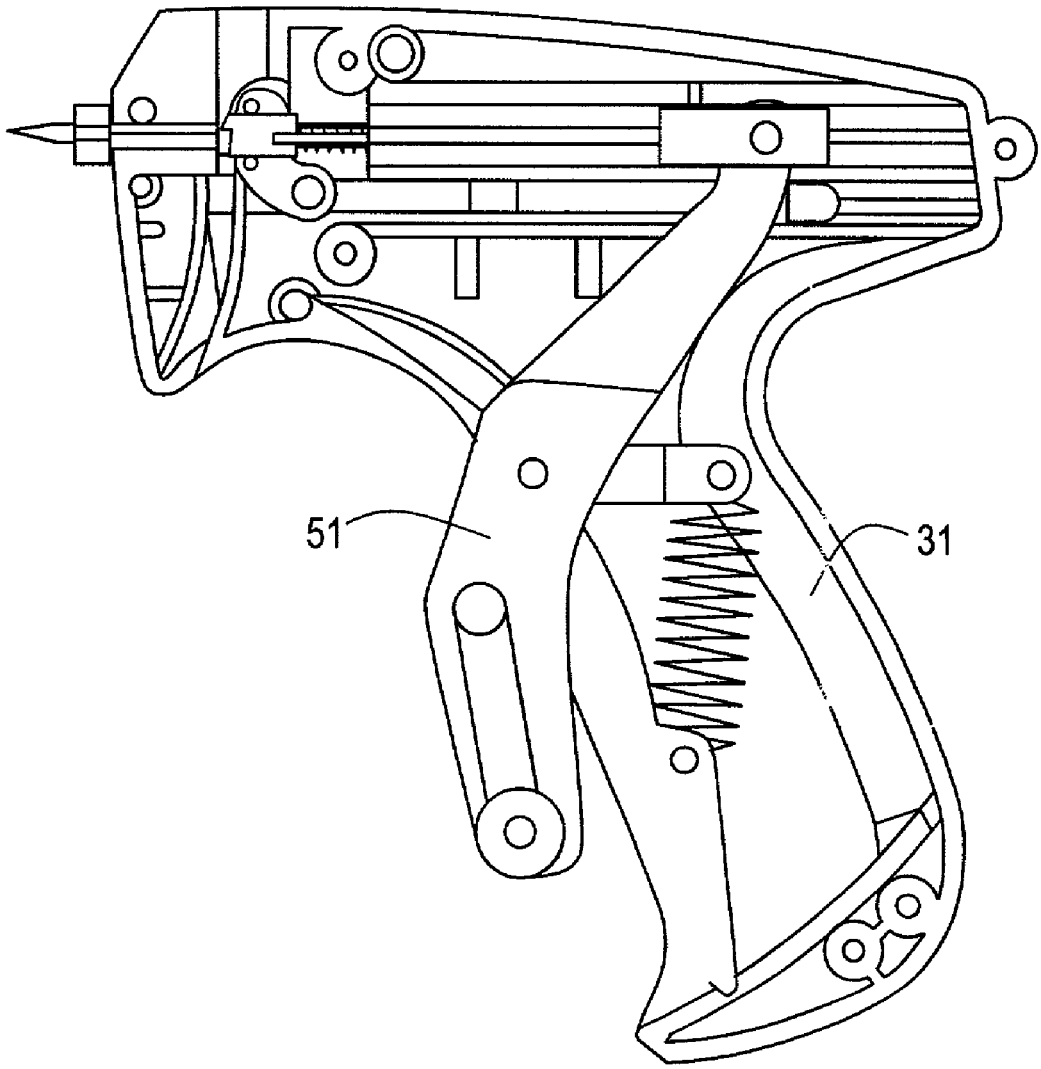
FIG. 11A is a side view similar to FIG. 11 but with the trigger and trigger spring removed.
Figure 12:
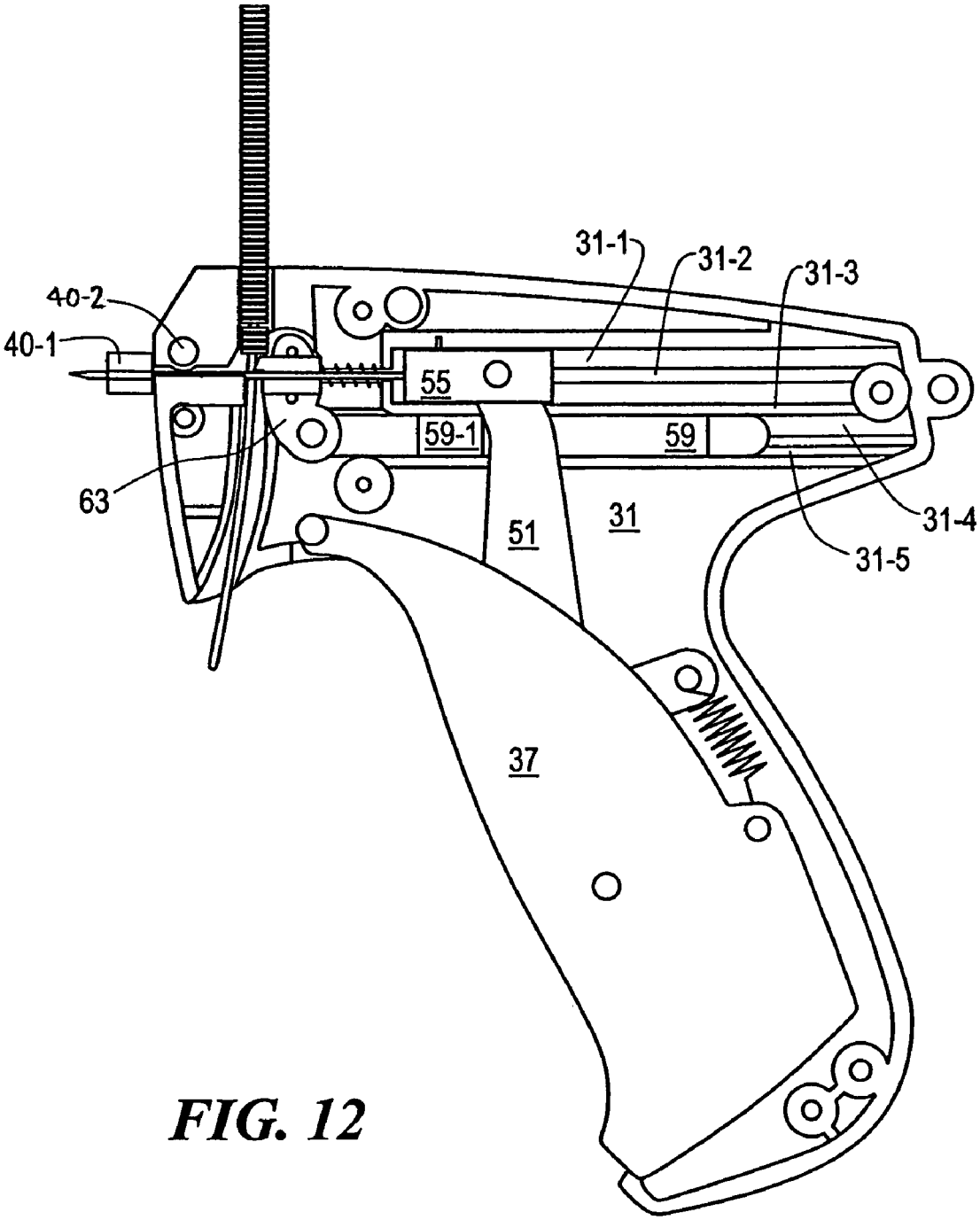
FIG. 12 is a side view of the tool and fastener clip shown in FIG. 8 with the left half of the casing removed and the feed slide in a indexing position.
Figure 13:
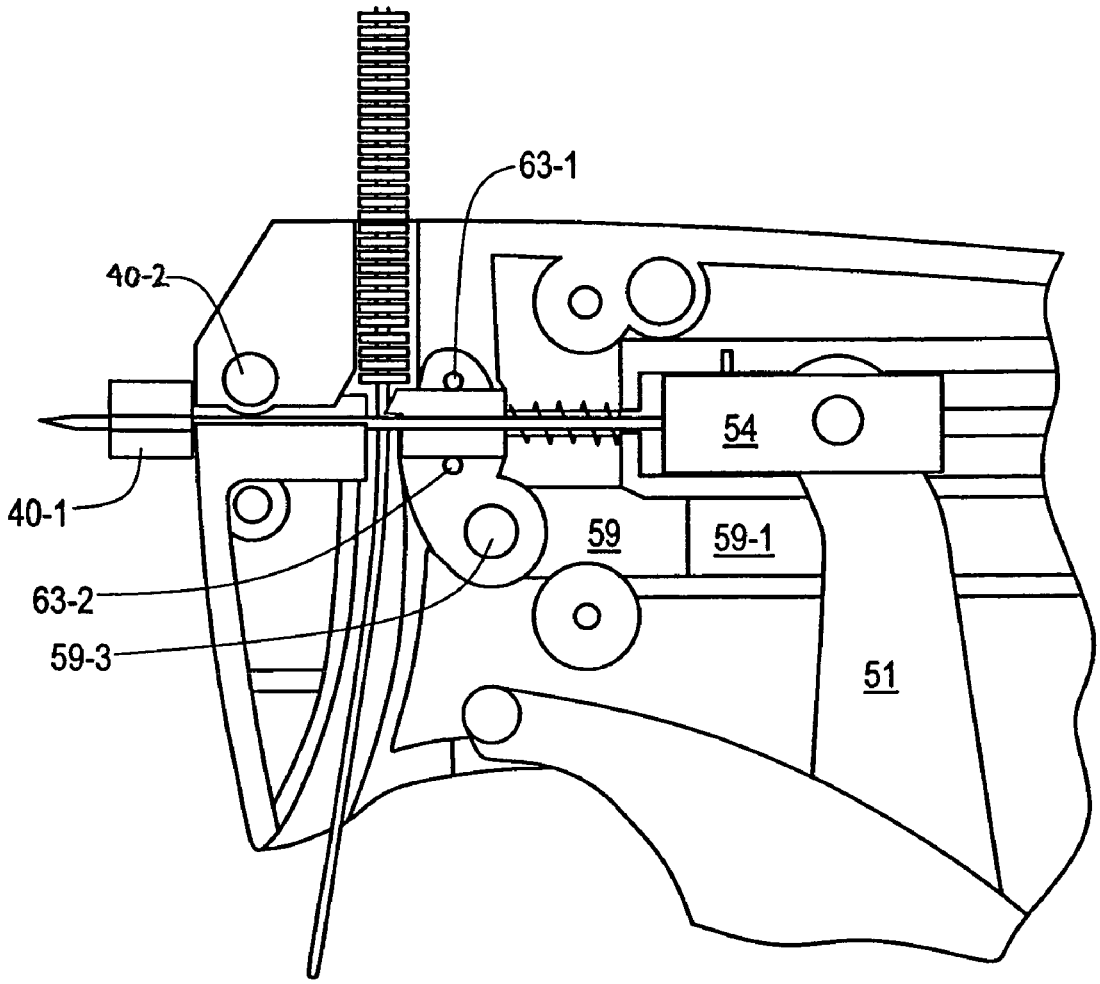
FIG. 13 is an enlarged view of the front end of the tool and fastener clip shown in FIG. 9.
Figure 15:
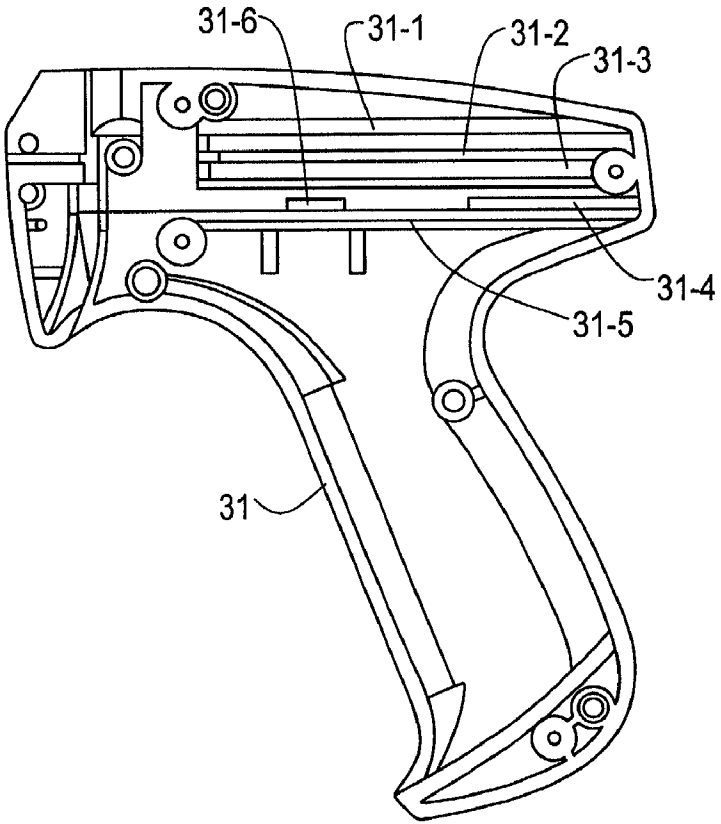
FIGS. 14 and 15 are perspective and side views, respectively, of the right body half of the tool in FIG. 9.
Figure 14:
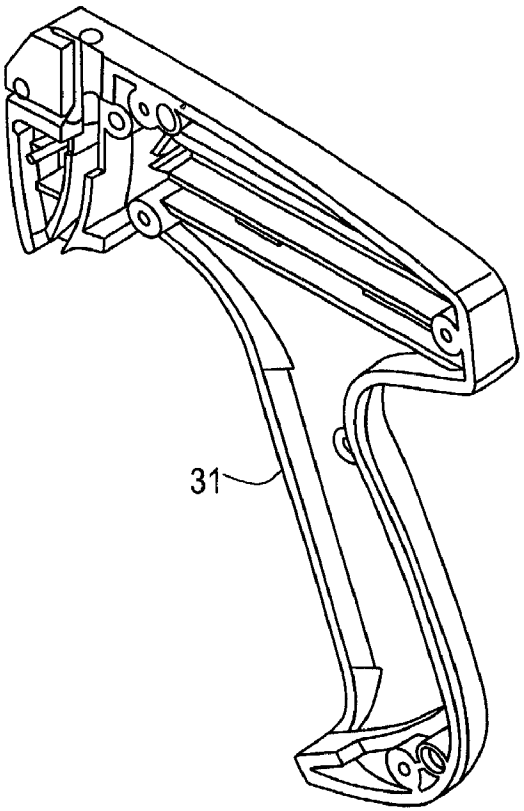
Figure 17:
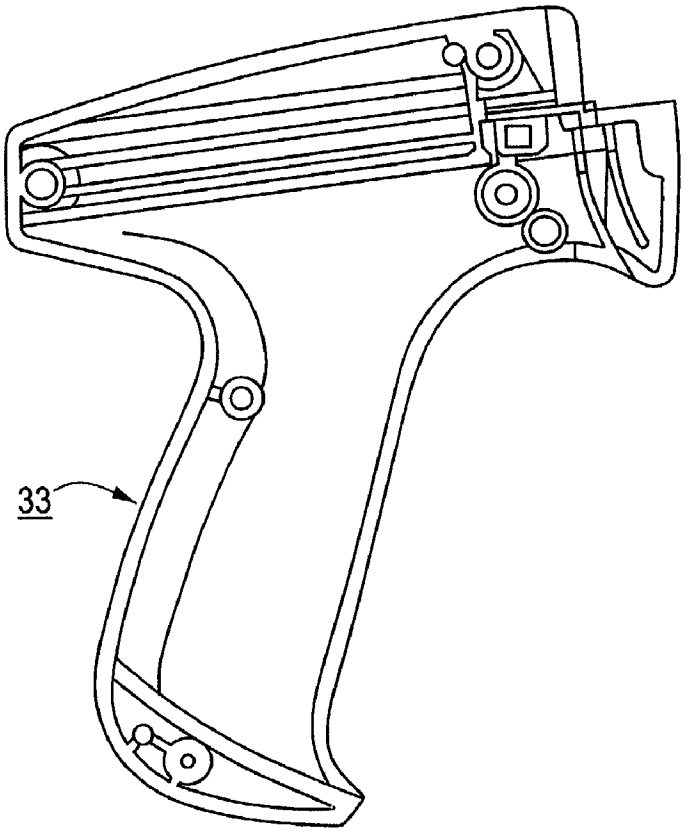
FIGS. 16 and 17 are perspective and side views, respectively, of the left body half of the tool in FIG. 9.
Figure 16:
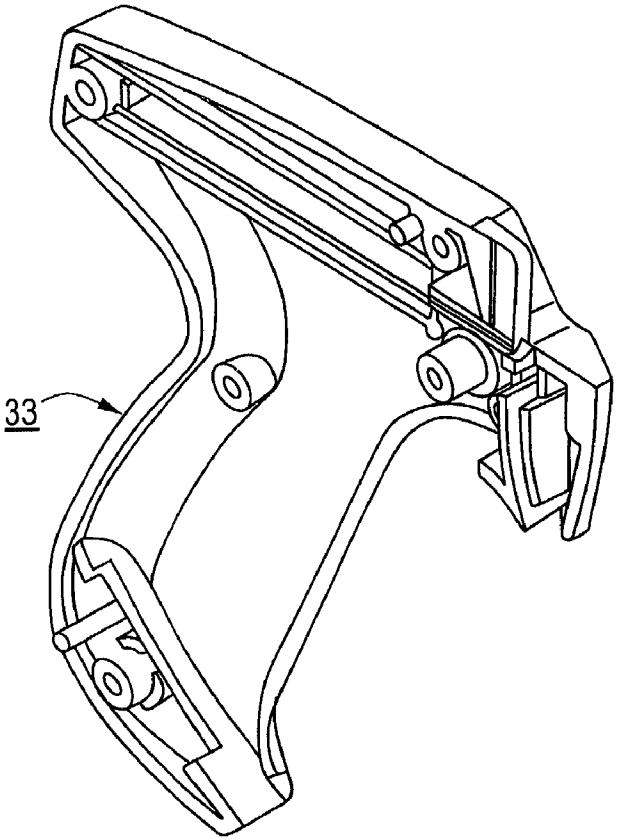
Figure 18:
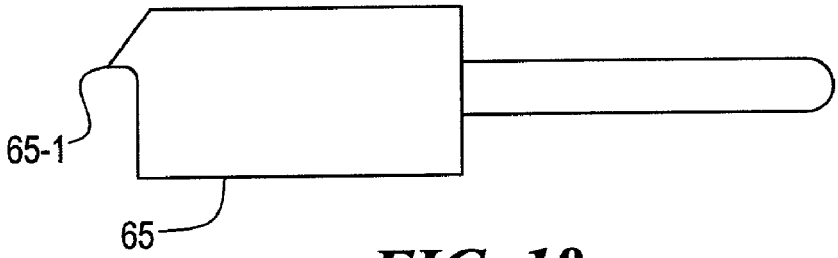
FIGS. 18 through 20 are plan, top and side views respectively of the feed pawl in the tool shown in FIG. 9.
Figure 19:
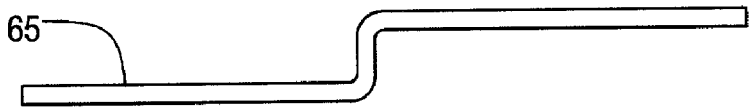
Figure 20:
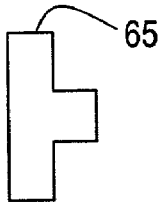
Figure 21:
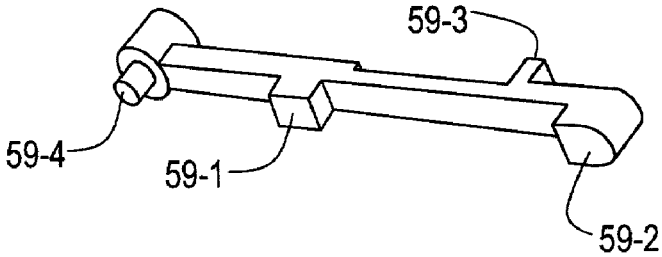
FIG. 21 is a perspective view of the feed slide shown in FIG. 11.
Figure 22:
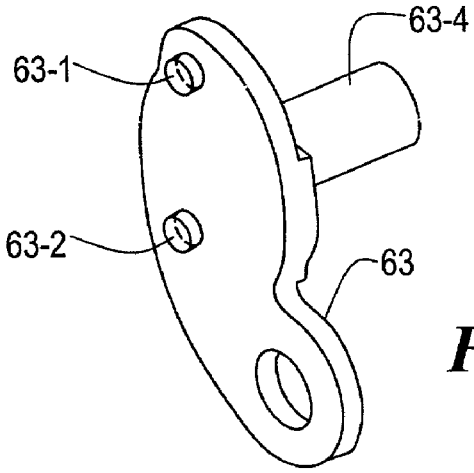
FIG. 22 is a perspective view of the feed cam shown in FIG. 9.
Figure 23:
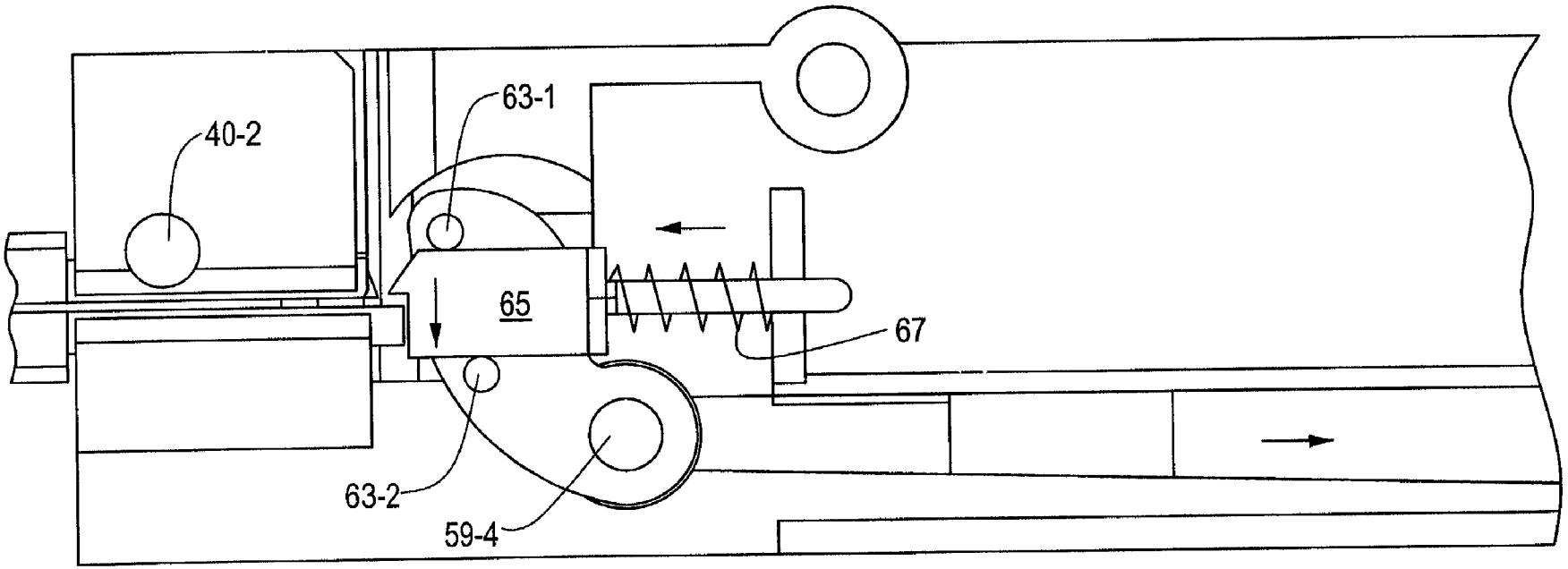
FIGS. 23 and 24 are fragmentary pictorial sketches of the tool shown in FIG. 9, with the feed mechanism in the index and feed positions, respectively.
Figure 24:
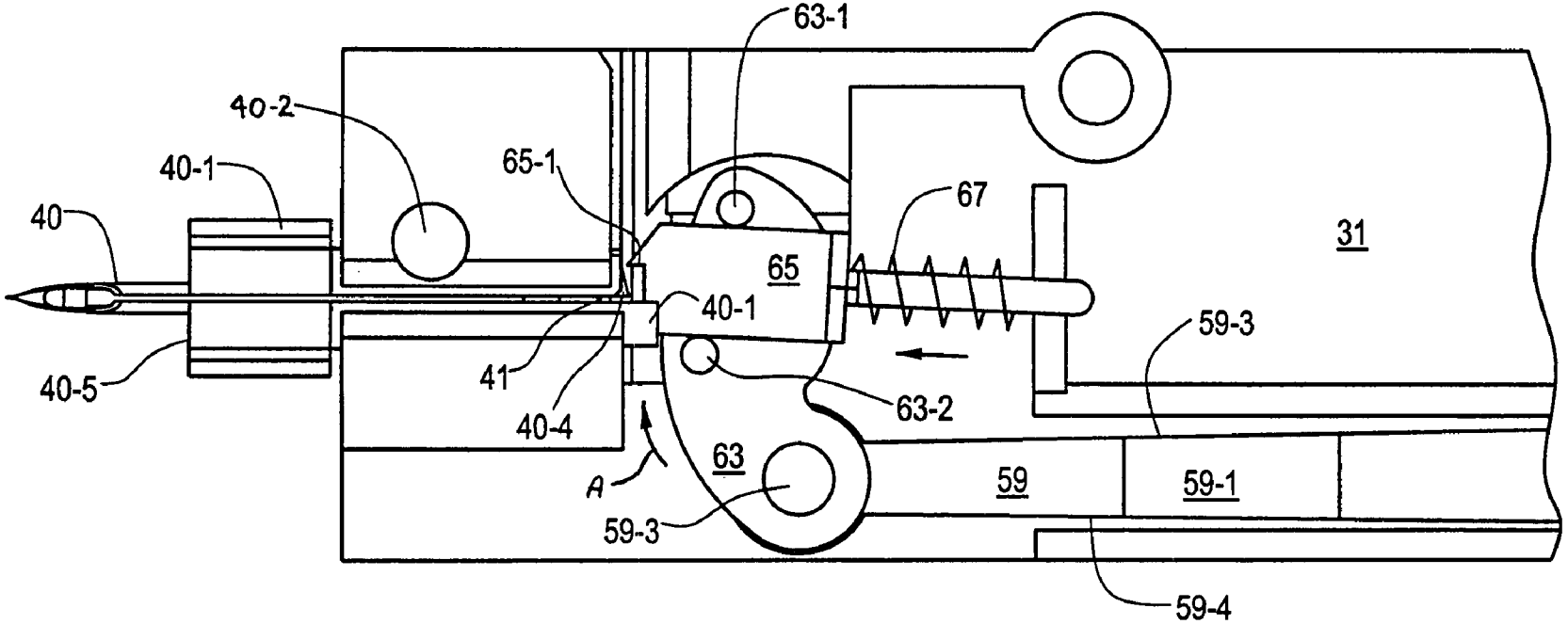
Figure 25:
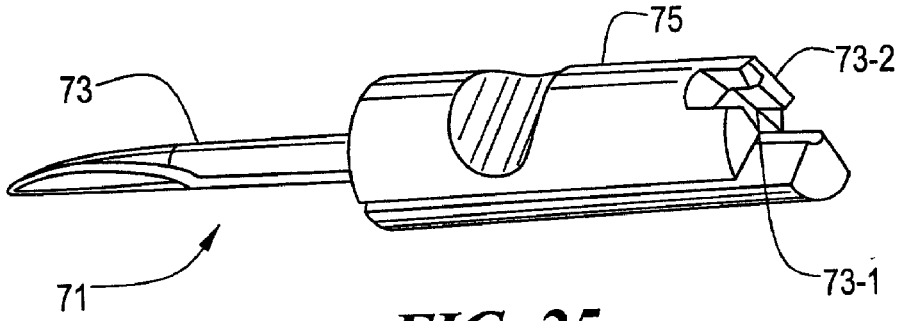
FIGS. 25 through 28 are perspective, side, top and bottom views respectively of another embodiment of the needle assembly for the tool shown in FIG. 9.
Figure 26:
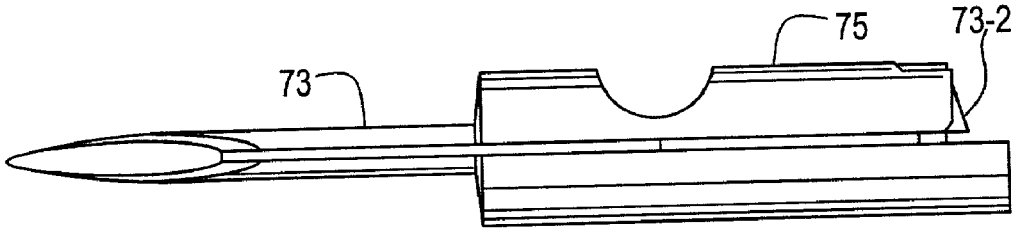
Figure 27:
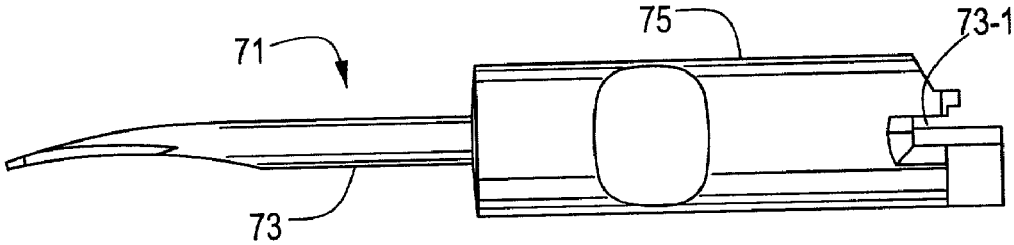
Figure 28:
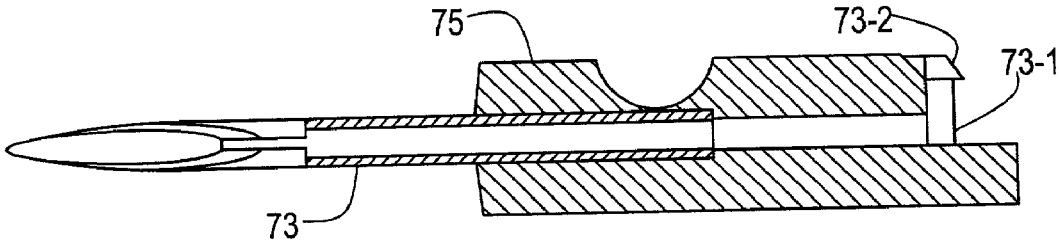

Referring now to the remaining Figures, there are shown in FIGS. 8 and 9 top and side perspective views of a tool constructed according to this invention for dispensing plastic fasteners 13 from fastener clip 11, the tool being identified by reference numeral 24. In FIG. 9, in the drawings, clip 11 is shown partially inserted in tool 24.

Tool 24 includes a hollow gun-shaped casing 25 having a handle portion 27 and a barrel portion 29. Casing 25 is formed of a right half 31 and a left half 33. Body half 31 includes five elongated ribs 31-1, 31-2, 31-3, 31-4 and 31-5. Halves 31 and 33 may be fabricated from any convenient material, such as molded plastic and are joined together by screws 35. Alternatively, halves 31 and 33 may be joined together by a snap-fit, by sonic welding, by gluing, by riveting or the like. Tool 24 is hand actuated by a lever type trigger link assembly located at the front of handle portion 27. The trigger link assembly includes a trigger 37. A guide groove 39 is formed in the top of barrel portion 29 into which fastener clip 11 is inserted. Tool 24 further includes a needle assembly which includes a hollow slotted needle 40 and a needle adapter 40-1. Needle adapter 40-1 is mounted in an opening in the front of casing 25 and hollow slotted needle 40 is mounted in needle adapter 40-1. Needle 40 is made of metal and needle adapter 40-1 is made of plastic. Needle adapter 40-1 is held in place in barrel portion 29 of casing 25 by a needle lock 40-2. Needle 40 includes an inlet opening 40-3 at the rear for receiving cross bar 15 of a fastener 13. The rear end of needle 40 includes a portion shaped to define a knife 41 which serves to separate a fastener 13 from the fastener clip 11 as it is fed into needle 40. An anti-back 40-4 is formed on a back surface of needle adapter 40-1. Antiback 40-4 prevents fastener stock 11 from backing up in guide groove 39 up during the feed operation. The front end 40-5 of needle adapter 40-2 serves as a stop to limit penetration of the needle 40 into an object to which a fastener is to be applied. In the operation of apparatus 23, fastener clip 11 is inserted into groove 39 of tool 24. Cross bar 15 of a fastener 13 to be dispensed is fed into needle 40 through inlet opening 40-3 and is then pushed out through tip 40-5 of needle 40 as will hereinafter be described.

Trigger 37 is pivotally mounted on right half 31 of casing 25 by an integrally formed pivot pin 46. Trigger link assembly further includes a compression spring 47, a connector bar 47-1, an idler link 47-2, a pin 49, a trigger link 51 and a pin 54. Trigger 37 is held biased outward by compression spring 47 which is mounted on connector bar 47-1. Connector bar 47-1 is pivotally connected at one end to idler link 47-2 and is pivotally connected at its other end to trigger 37. The other end of idler link 47-2 is pivotally connected at one end by pin 48 and 49 to trigger link 51. One end of trigger link 51 is pivotally attached to trigger 37. The other end of 53 of trigger link 51 is pivotally attached by pin 54 to an ejector slide 55.

An ejector rod 56 is fixedly mounted on the front end of ejector slide 55 and is used to push the cross bar of a fastener out through needle 40. Ejector slide 55 and ejector rod 56 together from an ejection mechanism for pushing fasteners through needle 40. Tool 24 further includes a feed mechanism for feeding fasteners into needle 40. The feed mechanism includes a feed slide 59, a feed slide spring 61, a feed cam 63, a feed pawl 65 and a feed pawl spring 67. Feed slide spring 61 is disposed on body half 31 between ribs 31-6 between ribs 31-6 and 41-7. Feed slide 59 which is made of a rigid material, such as DELRIN, includes front and rear projections 59-1 and 59-2, respectively on the top and a center projection 59-3 on the bottom for engaging feed slide spring 61. Sides 59-3 and 59-4 of feed slide 59 are tapered to allow feed slide 59 to move up and down as between ribs 41-3 and 31-5 as cam 63 rotates. Feed cam 63, which is made of plastic such as STANYLTW 344, includes upper and lower projections 63-1 and 63-2 on its front surface 63-8. The front end of feed slide 59 is pivotally mounted on feed cam 63 by a pin 59-3 which is integrally molded onto feed slide 59 and extends through a hole formed in feed cam 63. Feed cam 63, which is made of plastic, is pivotally mounted on the right half of casing 25 by an interally formed pin 31-1. Feed pawl 65 is made of metal such as, for example, nickel plated steel 65 and is disposed on front surface 63-3 feed cam 63 between projections 63-1 and 63-2 and is urged forward by feed pawl spring 67. Feed pawl is shaped to define a tooth 65-1 at its front end for engaging a stub 21 on clip 11.

Tool 24 further includes a needle guard 69.

Tool 24 operates in the following manner:

Index Position

When trigger 37 is squeezed all the way, trigger link 51 hits up against front projection 59-1 and pushes feed slide 59 forward. As noted before, sides 59-3 and 59-4 of feed slide 59 are tapered to allow it to compensate for up and down movement of feed slide 59 resulting from the rotation of the feed cam 63. The forward motion of feed slide 59 rotates feed cam 63 clockwise. The rotation of feed cam 63 clockwise causes the two off center projections 63-1 and 63-2 to move in the upward direction as shown by arrow A. These projections which are in contact with the sides 65-3 and 65-4 of feed pawl 65 move feed pawl 65 upward so that finger 65-1 engages the next fastener stub of clip 11. Feed pawl spring 67 maintains a forward force on the feed pawl 65 which keeps the feed pawl 65 engaged with the fastener clip. At the same time, as trigger 37 is squeezed trigger link 51 moves ejector slide 55 forward, pushing ejector rod 56 into needle.

Feed Position

When trigger 37 is released, spring 61 which is under feed slide 59 causes feed slide 59 to move rearward. The feed slide motion rotates feed cam 63 counterclockwise, which in turn moves feed pawl 65 down, carrying with it the stub of the next fastener and thus moving the next fastener into position. At the same time, ejector rod 56 is moved backward out of needle 40.

Referring now to FIG. 25 through 28, there are shown perspective, side, top and bottom views of another embodiment of the needle assembly. This other embodiment of the needle assembly comprises a needle 71 having a stem portion 73 and a base portion 75. Stem portion 73 is made of stamped and rolled metal. The rear end of stem portion 73 constitutes a knife edge 73-1. Base portion 75 is made of plastic that has been inserted molded onto stem portion 73. The rear end of base portion 75 has a surface 75-1 which is shaped to define an antiback. The front end 75-2 of base portion serves as a stop to limit penetration of needle 71 into an object to which a fastener is to be applied. Needle 71 is held in place in casing 25 by needle lock 40-2.

The embodiments of the present invention recited herein are intended to be merely exemplary and those skilled in the art will be able to make numerous variations and modifications to it without departing from the spirit of the present invention. As such variations and modifications are intended to be within the scope of the present invention as defined by the claims appended hereto.

What is claimed is:

1. A fastener clip comprising:

a. a first fastener, said first fastener comprising a flexible filament having a first cross bar at one end;

b. a second fastener, said second fastener comprising a flexible filament having a first cross bar at one end;

c. said first fastener and said second fastener being arranged in a parallel, side-by-side, spaced relationship;

d. a first connector post connecting said first cross bar of said first fastener to said first cross bar of said second fastener;

e. an elongated runner bar spaced apart from the first cross bar ends of said first and second fasteners; and f. an off center stub connecting said elongated runner bar to the first cross bar end of said first fastener, said off center stub having a first end which is formed onto the first enlarged end of said first fastener.

2. The fastener clip as claimed in claim 1 wherein said first fastener further comprises a second cross bar at a second end of said flexible filament and wherein said second fastener further comprises a second cross bar at a second end of said flexible filament.

3. The fastener clip as claimed in claim 2 further comprising a second connector post connecting said second cross bar of said first fastener to said second cross bar of said second fastener.

4. The fastener clip as claimed in claim 1 wherein said first fastener and said second fastener are spaced at a pitch of approximately 0.032 inch.

5. The fastener clip as claimed in claim 1 further comprising one or more additional fasteners connected to said runner bar and arranged in a parallel, side-by-side, spaced relationship and wherein said runner bar extends in a first direction beyond said first fastener and in a second direction beyond said one or more additional fasteners in an unequal fashion so as to easily indicate which end of said runner bar is to be inserted into a fastener dispensing tool.

6. The fastener clip as claimed in claim 1 wherein said off center stub has a flat inner surface.

7. The fastener clip as claimed in claim 1 wherein each of said first cross bar of said first fastener and said first cross bar of said second fastener has a length of about 0.11 inch.

8. The fastener clip as claimed in claim 1 further comprising a second off center stub, said second off center stub connecting said elongated runner bar to said first cross bar of said second fastener.

9. A fastener clip comprising:

a. a first fastener, said first fastener comprising a flexible filament having a first cross bar at a first end thereof, said first cross bar having a length of approximately 0.11 inch;

b. a second fastener, said second fastener comprising a flexible filament having a first cross bar at a first end thereof;

c. said first fastener and said second fastener being arranged in a parallel, side-by-side, spaced relationship;

d. an elongated runner bar spaced apart from the first cross bars of said first and second fasteners;

e. a first stub connecting said elongated runner bar to said first cross bar of said first fastener, wherein said first stub connects said elongated runner bar to said first cross bar of said first fastener in an off-center manner; and f. a second stub connecting said elongated runner bar to said first cross bar of said second fastener, wherein said second stub connects said elongated runner bar to said first cross bar of said second fastener in an off-center manner.

10. The fastener clip as claimed in claim 9 wherein said first cross bar of said second fastener has a length of approximately 0.11 inch.

11. The fastener clip as claimed in claim 9 wherein said first fastener and said second fastener are spaced at a pitch of approximately 0.032 inch.

12. The fastener clip as claimed in claim 9 wherein said flexible filament of said first fastener has a length of approximately 0.176 inch.

13. The fastener clip as claimed in claim 9 wherein said first fastener further comprises a second cross bar at a second end of said flexible filament and wherein said second fastener further comprises a second cross bar at a second end of said flexible filament.

14. A fastener clip comprising:

a. a first fastener, said first fastener comprising a flexible filament having a first cross bar at a first end thereof;

b. a second fastener, said second fastener comprising a flexible filament having a first cross bar at a first end thereof;

c. said first fastener and said second fastener being arranged in a parallel, side-by-side, spaced relationship at a pitch of approximately 0.032 inch;

d. an elongated runner bar spaced apart from the first cross bars of said first and second fasteners;

e. a first stub connecting said elongated runner bar to said first cross bar of said first fastener, wherein said first stub connects said elongated runner bar to said first cross bar of said first fastener in an off-center manner; and f. a second stub connecting said elongated runner bar to said first cross bar of said second fastener.

15. The fastener clip as claimed in claim 14 further comprising a first connector post connecting said first cross bar of said first fastener to said first cross bar of said second fastener.

16. The fastener clip as claimed in claim 15 wherein said first fastener further comprises a second cross bar at a second end of said flexible filament and wherein said second fastener further comprises a second cross bar at a second end of said flexible filament.

* * * * *